United States Patent [19]

Isaka et al.

[11] 4,412,155

[45] Oct. 25, 1983

[54] AGING METHOD FOR THIN-FILM ELECTROLUMINESCENT DISPLAY ELEMENT

[75] Inventors: Kinichi Isaka, Tenri; Masashi Kawaguchi, Nara; Hisashi Uede, Wakayama, all of Japan

[73] Assignee: Sharp Kabushiki Kaisha, Osaka, Japan

[21] Appl. No.: 274,741

[22] Filed: Jun. 18, 1981

[30] Foreign Application Priority Data

Jun. 23, 1980 [JP] Japan ..... 55-85705

[51] Int. Cl.[3] ..... H05B 33/10

[52] U.S. Cl. ..... 315/246; 315/169.3; 445/6

[58] Field of Search ..... 315/169.3, 246; 316/1, 316/27; 340/760, 781; 445/6

[56] References Cited

U.S. PATENT DOCUMENTS

| | | | |
|---|---|---|---|
| 3,185,893 | 5/1965 | Sperling | 315/246 |
| 3,708,708 | 1/1973 | Soxman | 315/246 X |
| 4,206,460 | 6/1980 | Yasuda et al. | 315/169.3 X |
| 4,253,097 | 2/1981 | Hochstrate | 340/781 |

*Primary Examiner*—Eugene R. La Roche

*Attorney, Agent, or Firm*—Birch, Stewart, Kolasch & Birch

[57] ABSTRACT

An aging method for a thin-film electroluminescent display element comprises the steps of applying an AC voltage having at least one characteristic selected from the features that its frequency is approximately within 500 Hz through 10 KHz, its pulse width is approximately within 20 μsec through 100 μsec, and its voltage is of a magnitude, at which a virgin thin-film electroluminescent display element starts to emit electroluminescence, plus 30 V through 60 V.

8 Claims, 9 Drawing Figures

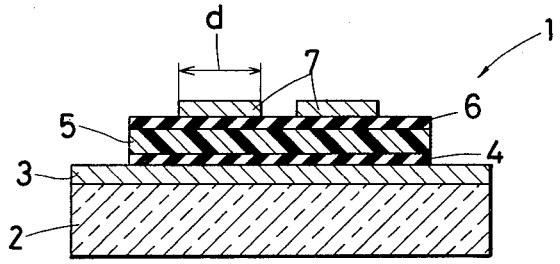
FIG. 1
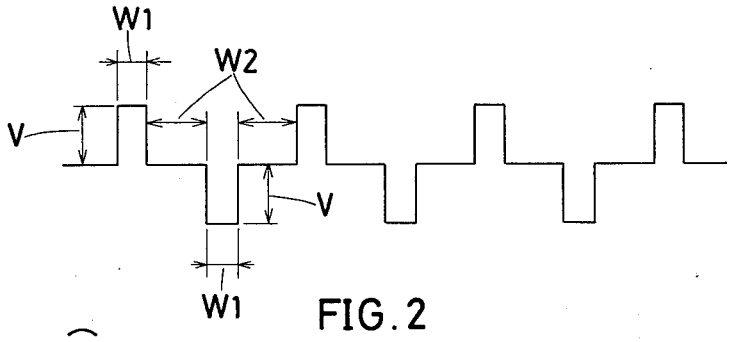
FIG. 2
FIG. 3
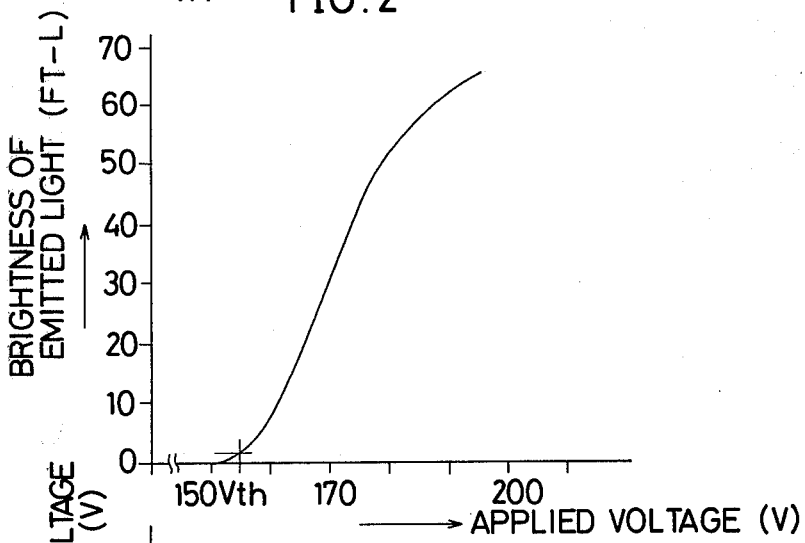
FIG. 4
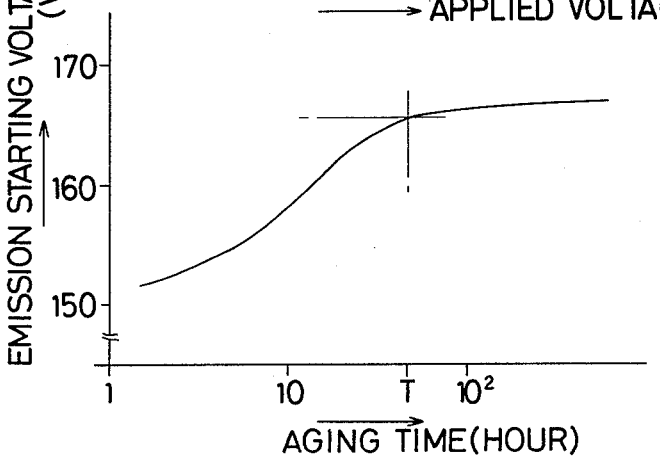

AGING METHOD FOR THIN-FILM ELECTROLUMINESCENT DISPLAY ELEMENT

BACKGROUND OF THE INVENTON

The present invention relates to a thin-film electroluminescent (referred to as "EL" hereinbelow) display element and, more particularly, to a method for aging such a thin-film EL display element.

It is necessary to conduct an aging procedure, with a voltage applied, on a thin-film EL display element so as to stabilize its optical properties such as brightness of emitted light, and its physical properties such as dielectric breakdown properties.

In order to shorten the time required to complete the aging procedure, it was presumed that the magnitude, pulse width, and/or frequency etc., of the voltage applied to electrode means of the thin-film EL display element should be increased. However, if this was actually conducted, dielectric breakdown occurred.

In view of the foregoing, it was usual that the aging procedure was conducted with a voltage lower than the voltage applied to provide electroluminescence. As a result, about 50–60 hours were conventionally required to complete the aging procedure.

Consequently, it was desired to shorten the aging time and prevent the dielectric breakdown of the thin-film EL display element.

SUMMARY OF THE INVENTION

Accordingly, it is an object of the present invention to provide an improved aging procedure for application to a thin-film EL display element.

It is another object of the present invention to provide an improved aging procedure for application to a thin-film EL display element for the purpose of completing the aging procedure within a shortened time while preventing the occurrence of dielectric breakdown.

Briefly described, in accordance with the present invention, a method for aging a thin-film electroluminescent display element comprises the steps of applying an AC voltage having at least one characteristic selected from the features that its frequency is approximately within 500 Hz through 10 KHz, its pulse width is approximately within 20 μsec through 100 μsec, and its voltage magnitude is at a level at which a virgin thin-film electroluminescent display element starts to emit electroluminescence plus 30 V through 60 V.

BRIEF DESCRIPTION OF THE DRAWINGS

The present invention will become more fully understood from the detailed description given hereinbelow and the accompanying drawings which are given by way of illustration only, and thus are not limitative of the present invention and wherein:

FIG. 1 shows a cross-sectional view of a thin-film EL display element;

FIG. 2 shows the waveform of a voltage applied for an aging procedure according to the present invention;

FIG. 3 shows a graph representing a relationship between the magnitude of an applied voltage and brightness of emitted light from the thin-film EL display element;

FIG. 4 shows a graph representing a relationship between an aging time and an emission starting voltage;

DESCRIPTION OF THE INVENTION

Figure 5:
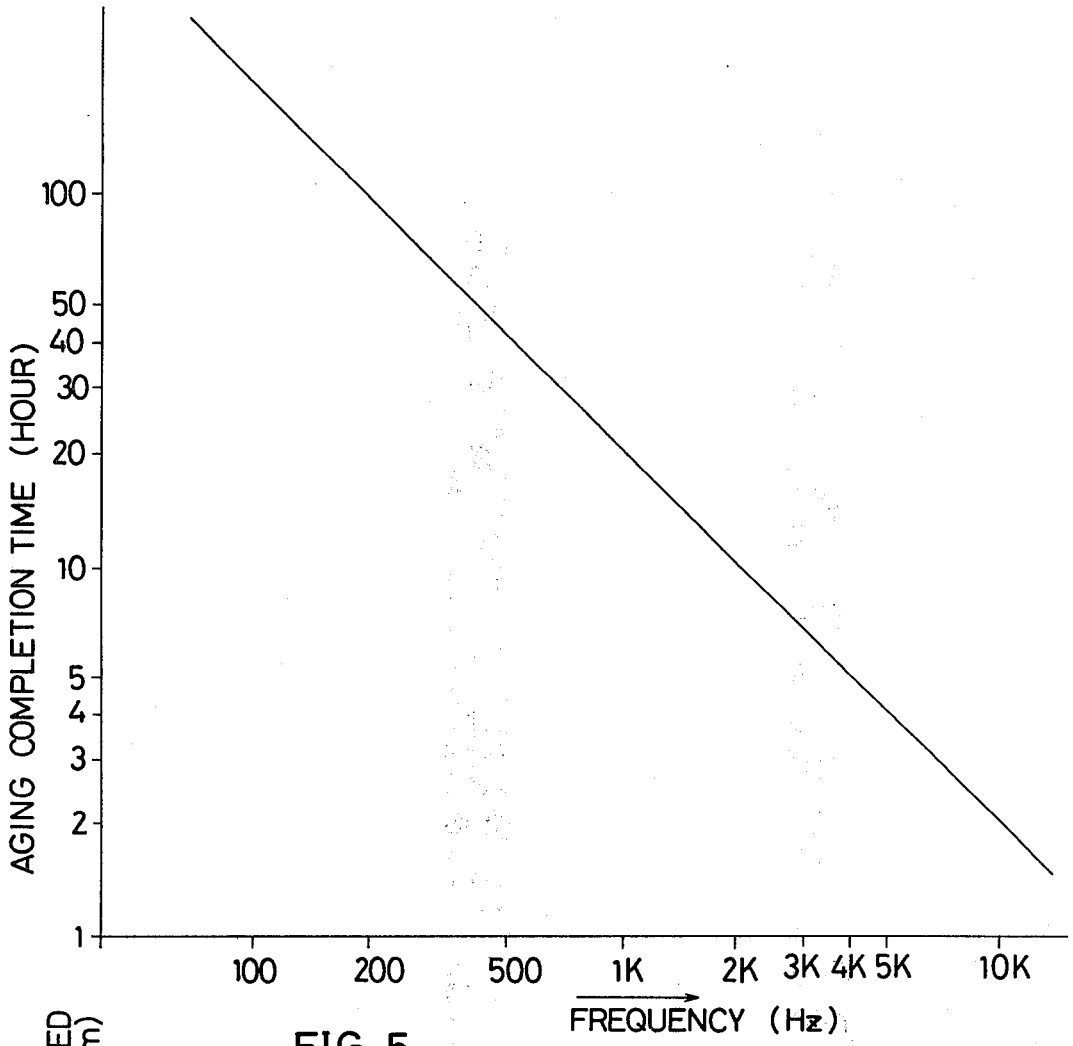
FIG. 5 shows a graph representing a relationship between an aging completion time and the frequency of an applied voltage.

FIG. 1 shows a thin-film EL display element 1 comprising a flat glass substrate 2, transparent conductive electrodes 3, a first dielectric layer 4, a second dielectric layer 6, a EL thin film 5 and counter conductive electrodes 7.

The transparent electrodes 3 are made of $In_2O_3$ or $SnO_2$ etc. The counter electrodes 7 are made of a metal such as Al etc.

The transparent electrodes 3 are arranged on the glass substrate 2 in parallel with each other, preferably, with a width of about 200–300 μm. The counter electrodes 7 are arranged so that they cross at a right angle relative to the transparent leecttodes 3 in a plane view, preferably, with a similar width.

A cross point between the transparent electrodes 3 and the counter electrodes 7 comprises an element for the EL panel. AC power is applied to the transparent electrodes 3 and the counter electrodes 7.

The EL display element comprises an EL thin film interposed between first and second dielectric layers. The first dielectric layer 4 comprises $Y_2O_3$, $TiO_2$, $Al_2O_3$, $Si_3N_4$ and $SiO_2$ etc. which is disposed by a sputtering technique or by electron beam evaporation with a thickness of, preferably, about 2000Å. The EL thin film 5 has, preferably, a thickness of about 6000Å–8000Å and is made of a ZnS thin film doped with manganese in a desired amount. The second dielectric layer 6 comprises a similar material as that of the first dielectric layer 3, with a thickness of about 2000Å.

Across each pair of the transparent electrodes 3 and the counter electrodes 7, an AC voltage is applied whose waveform is shown in FIG. 2. In response to application of the AC voltage, the EL display element 1 emits electroluminescence as shown in FIG. 3. Throughout the present specification, the magnitude of a voltage applied to provide electroluminescence of 1 foot-lambert (ft-L) is defined to be an emission starting voltage $V_{th}$. FIG. 4 shows a typical graph indicating a relationship between the emission starting voltage $V_{th}$ and an aging time required.

As viewed from FIG. 4, the emission starting voltage $V_{th}$ greatly varies at the beginning of the aging procedure. After a certain time T lapses, the voltage $V_{th}$ becomes constant. This time T is defined herein to be an aging completion time. In FIG. 4, the frequency of the applied voltage is about 1 KHz and the pulse width $W_1$ thereof is about 40 μsec.

Rectangular voltage pulses as shown in FIG. 2 should be used for operating the thin-film EL display element 1. Sinusoidal or triangular waves are not efficient for driving purposes.

According to our experiments, the aging completion time T is dependent on the frequency of the applied voltage of FIG. 2, as viewed in FIG. 5. In FIG. 5, the plotted data is in log-log scale. In FIG. 5, the applied voltage is constant at about 200 V and the pulse width W1 is constant at about 40 μsec.

As can be seen from the graph of FIG. 5, the aging completion time T is substantially inversely proportional to the frequency. In order to make the aging completion time T less than 48 hours, it is necessary for the frequency to be about 500 Hz or more.

When the frequency becomes about 10 KHz or more, sufficient brightness of electroluminescence is not obtained on account of very short pulse width $W_1$. At the same frequency, the thin-film EL display element 1 is remarkably heated. Therefore, such a frequency is not suitable.

Consequently, the frequency of the applied voltage is preferably from about 500 Hz inclusive to 10 KHz. It is more preferably from 500 Hz inclusive to 2.5 KHz noninclusive to provide the electroluminescence of about 30–40 ft-L, which is desired in practice, during the aging procedure.

When dielectric breakdown is caused in the display element 1, some pin holes are produced. The diameter of the pin holes must be kept smaller than the width of each of the transparent electrodes 3 and the counter electrodes 7. If not, an account of the pin holes, breaking of continuity may take place at any of the transparent electrodes 3 and the counter electrodes 7 thereby disabling any display by the electroluminescence.

Figure 6:
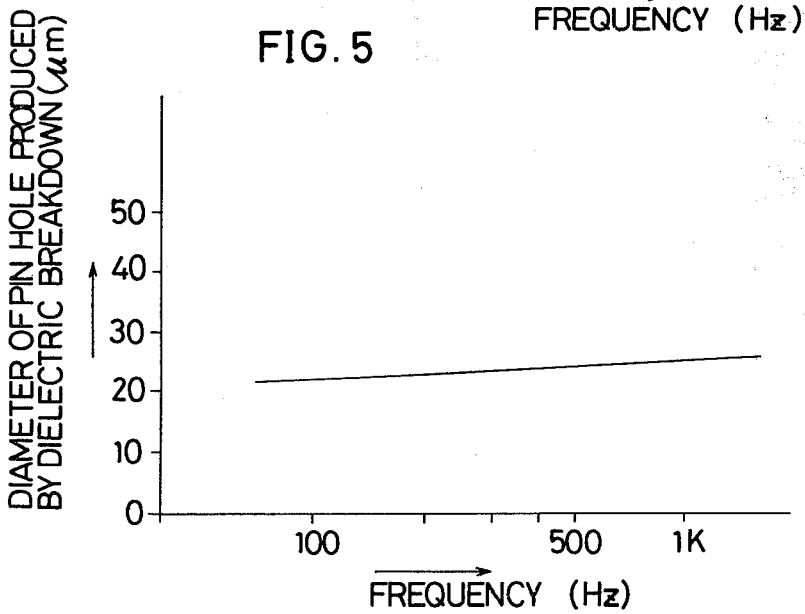
FIG. 6 shows a graph representing a relationship between the frequency and the diameter of a pin hole produced by dielectric breakdown.

According to our experiments, the diameter of the pin hole is independent of the frequency of an applied voltage as indicated in FIG. 6. In FIG. 6, the pulse width $W_1$ of an applied voltage is constant at about 40 μsec.

Figure 7:
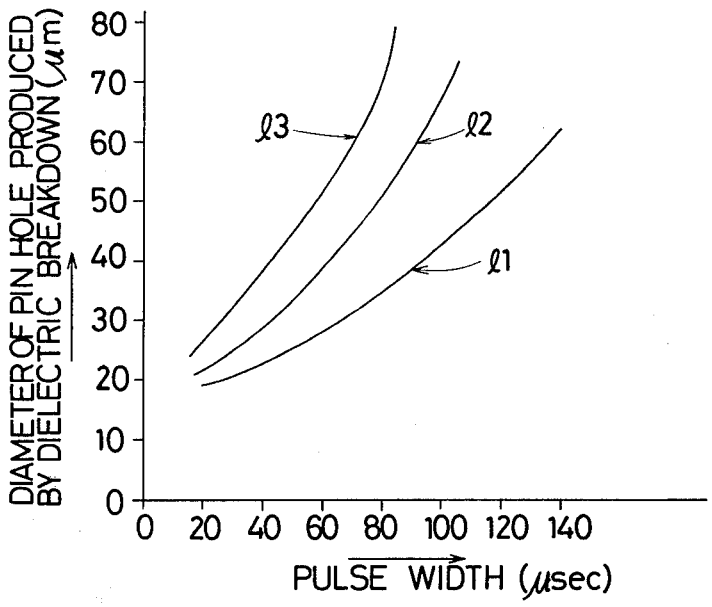
FIG. 7 shows a graph representing a relationship between the pulse width of an applied voltage and the diameter of a pin hole produced by dielectric breakdown.

The diameter of the pin hole is dependent on the pulse width $W_1$ as shown in FIG. 7. In FIG. 7, each data set $l_1$, $l_2$, and $l_3$ is obtained at voltages of 170, 180 and 190 V, respectively, while the frequency of the applied voltage is constant at a certain value within 500 Hz to 10 KHz.

The graph of FIG. 7 indicates that the pulse width $W_1$ of the applied voltage should be selected to be from 20 μsec inclusive to 100 μsec noninclusive to thereby keep the diameter of the pin hole, if any, less than the width of each of the electrodes 3 and 7. Even if the dielectric breakdown occurs to produce some pin holes, it does not break the continuity of any of the electrodes 3 and 7 as a result of limiting the pulse width $W_1$ within this range according to the present invention.

When the pulse width $W_1$ is less than about 20 μsec, the aging procedure is ineffective since insufficient brightness suitable for the aging procedure is obtained. Preferably, the pulse width $W_1$ suitable for the aging procedure is selected to be from 40 μsec inclusive to 70 μsec noninclusive to provide sufficient brightness suitable for this and to limit the diameter of pin holes less than about 50 μm.

Figure 8:
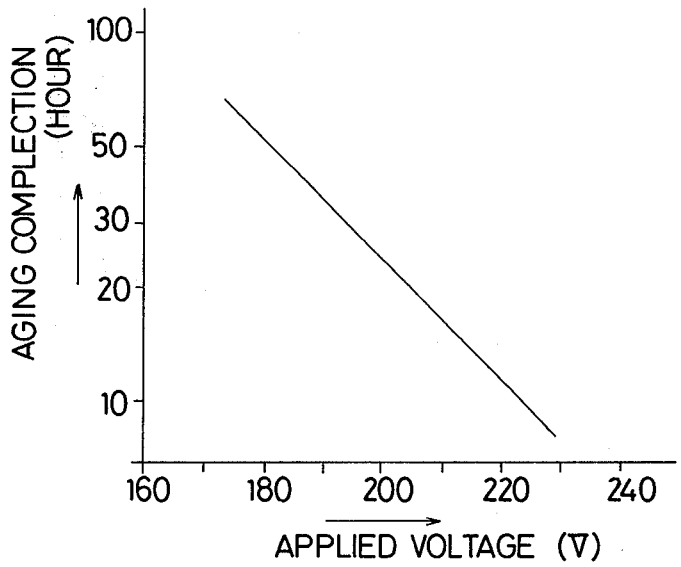
FIG. 8 shows a graph representing the relationship between aging completion time and the magnitude of an applied voltage.

According to our experiments, the aging completion time T is dependent on the magnitude of an applied voltage as viewed in FIG. 8. In FIG. 8, the frequency is constant to be 1 KHz and the pulse width $W_1$ is constnat to be 40 μsec. A plot of log (aging completion time) vs. applied voltage gives a straight line. This graph indicates that as the voltage increases, the aging completion time becomes shortened. To limit the aging completion time below 48 hours, the voltage should be selected to be about 180 V or more.

A virgin display element, which has not been subjected to any aging procedure, provides a minimum emission starting voltage $V_{th}$ of about 150 V from the graph of FIG. 4. As a result, in order to limit the aging completion time below 48 hours, it is preferable that the magnitude of the applied voltage be selected to be the minimum emission starting voltage $V_{th}$ plus 30 V or more. The value of 30 V is determined by subtracting 150 V, at which the virgin display element provides the minimum emission starting voltage, from 180 V at which the shortened aging time of 48 hours is obtained.

Figure 9:
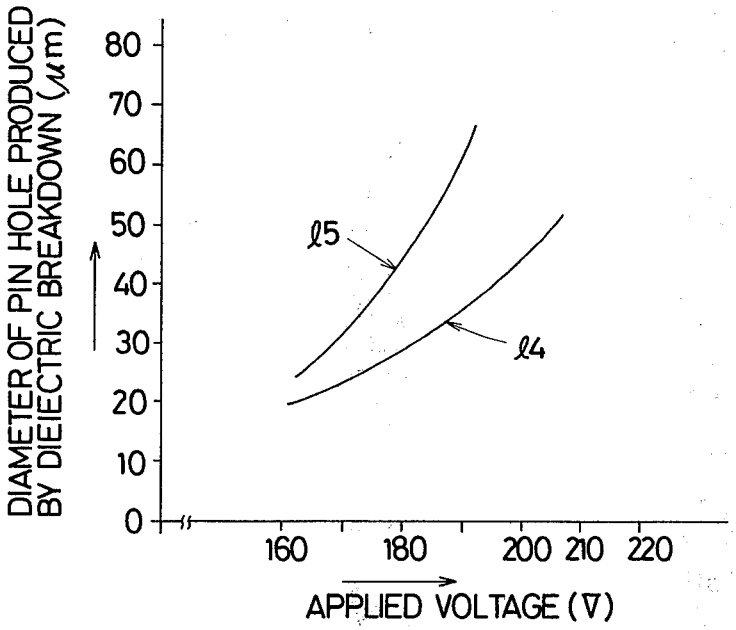
FIG. 9 shows a graph representing the magnitude of an applied voltage and the diameter of a pin hole produced by dielectric breakdown.

Finally, according to our experiments, the diameter of the pin holes vary dependending on the magnitude of the applied voltage as represented in FIG. 9. In FIG. 9, each data set $l_4$ and $l_5$ corresponds to each pulse widths $W_1$ of 40 and 70 μsec, respectively while the frequency of the applied voltage is made constant at a certain value from 500 Hz to 10 KHz.

As can be seen from the graph of FIG. 9, above 210 V, the diameter of the pin hole becomes much more than the width of each of the electrodes 3 and 7 to thereby reduce yield of this display element 1. It is preferable that the magnitude of the applied voltage be selected to be less than the minimum emission starting voltage $V_{th}$ in the virgin display element plus 60 V. This value of 60 V is determined by subtracting 150 V, at which any typical virgin display element provides the minimum emission starting voltage, from 210 V below which the aging procedure is enabled.

The emission starting voltage $V_{th}$ is different, depending on the structure of the display element 1. Typically, this is within about 150 to 190 V. In summary, it is preferable that the magnitude of the applied voltage be selected to be the emission starting voltage $V_{th}$ in the virgin display element plus 30 V or more and less than the emission starting voltage $V_{th}$ in the virgin display element plus 60 V.

It should be evident that the present invention can be applied to any other type of EL display element including an injection type.

The invention being thus described, it will be obvious that the same may be varied in many ways. Such variations are not to be regarded as a departure from the spirit and scope of the invention, and all such modifications are intended to be included within the scope of the following claims.

What is claimed is:

1. A method for aging a thin-film electroluminescent display element comprising the steps of:

applying an AC voltage to electrode means of the element, the frequency of the AC voltage being approximately 500 Hz through 10 KHz.

2. The method of claim 1, wherein the frequency is approximately 500 Hz through 2.5 KHz.

3. An aging method for a thin-film electroluminescent display element comprising the steps of:

applying an AC voltage to electrode means of the element, the pulse width of the AC voltage being approximately 20 μsec through 100 μsec.

4. The method of claim 3, wherein the pulse width is approximately 40 μsec through 70 μsec.

5. An aging method for a thin-film electroluminescent display element comprising the steps of:

applying an AC voltage to electrode means of the element, wherein the magnitude of the AC voltage is approximately at which a virsin thin-film electroluminescent display element starts to emit electroluminescense plus 30 V to voltage 60 V.

6. The method of claim 5, wherein the magnitude of the AC voltage is approximately 180 V through 210 V.

7. An aging method for a thin-film electroluminescent display element comprising the steps of:

applying an AC voltage to electrode means of the element, the frequency of the AC voltage being approximately 500 Hz through 10 KHz, the pulse width of the AC voltage being approximately 20 μsec through 100 μsec, and the magnitude of the AC voltage being approximately the voltage at which a virgin thin-film electroluminescent display element starts to emit electroluminescence plus 30 V to 60 V.

8. The method of claim 7, wherein the AC voltage has a rectangular waveform.

* * * * *